US007173405B2

(12) United States Patent
Bo et al.

(10) Patent No.: US 7,173,405 B2
(45) Date of Patent: Feb. 6, 2007

(54) METHOD AND APPARATUS FOR CURRENT LIMITATION IN VOLTAGE REGULATORS WITH IMPROVED CIRCUITRY FOR PROVIDING A CONTROL VOLTAGE

(75) Inventors: Gian Marco Bo, Savona (IT); Massimo Mazzucco, Savona (IT)

(73) Assignee: Atmel Corporation, San Jose, CA (US)

( * ) Notice: Subject to any disclaimer, the term of this patent is extended or adjusted under 35 U.S.C. 154(b) by 0 days.

(21) Appl. No.: 11/181,222

(22) Filed: Jul. 13, 2005

(65) Prior Publication Data

US 2005/0248326 A1 Nov. 10, 2005

Related U.S. Application Data

(63) Continuation-in-part of application No. 10/888,790, filed on Jul. 9, 2004.

(30) Foreign Application Priority Data

Jul. 10, 2003 (IT) ..... TO2003A0533
Apr. 12, 2005 (IT) ..... TO2005A0243

(51) Int. Cl.
*G05F 3/16* (2006.01)

(52) U.S. Cl. ..... 323/312; 323/315

(58) Field of Classification Search ..... 323/312, 323/313, 314, 315, 316, 280
See application file for complete search history.

(56) References Cited

U.S. PATENT DOCUMENTS 4,593,338 A 6/1986 Takeda et al. ..... 361/18
4,605,891 A 8/1986 Wrathall ..... 323/313
4,771,228 A * 9/1988 Hester et al. ..... 323/315
4,851,953 A 7/1989 O Neill et al. ..... 361/101
5,570,060 A 10/1996 Edwards ..... 327/541
5,614,850 A 3/1997 Corsi et al. ..... 327/55
5,789,971 A 8/1998 Colletti et al. ..... 327/541
5,955,915 A 9/1999 Edwards ..... 327/541
6,304,108 B1 10/2001 Inn ..... 327/72
6,396,311 B2 5/2002 Inn ..... 327/70
6,407,537 B2 6/2002 Antheunis ..... 323/312
RE37,778 E 7/2002 Feldtkeller ..... 323/277
6,476,667 B1 11/2002 Teggatz et al. ..... 327/538
6,480,043 B2 11/2002 Hall et al. ..... 327/108
6,522,111 B2 * 2/2003 Zadeh et al. ..... 323/277
6,580,257 B2 6/2003 Marty ..... 323/280

(Continued)

*Primary Examiner*—Adolf Berhane
(74) *Attorney, Agent, or Firm*—Sierra Patent Group, Ltd.

(57) ABSTRACT

A circuit for limiting a power current from a power-controlling pass device, the power-controlling pass device being coupled to a supply voltage, comprises the following. A sense device is coupled to the supply voltage with the sense device being configured to draw a sense current that is proportional to the power current. A current mirror is coupled to the sense device and the supply voltage through a low impedance node, the current mirror being configured to draw a mirror current through the low impedance node that is relative to the sense current. A limiting device is coupled to the supply voltage, the power-controlling pass device, and the low impedance node, the limiting device being configured to limit the power current according to a voltage difference between the low impedance node and the supply voltage. A resistance device or PMOS transistor that generates the voltage difference and that may be controlled through a proper bias circuit to adjust the voltage difference.

24 Claims, 7 Drawing Sheets

U.S. PATENT DOCUMENTS 6,801,419 B2 10/2004 Fukui ..... 361/93.1
6,804,102 B2 10/2004 Hamon et al. ..... 361/93.3
6,861,832 B2 * 3/2005 Perez ..... 323/316
7,005,924 B2 * 2/2006 Can et al. ..... 330/298
2002/0005738 A1 1/2002 Inn ..... 327/51
2004/0051508 A1 3/2004 Hamon et al. ..... 323/280
2005/0035749 A1 2/2005 Bo et al. ..... 323/315

* cited by examiner

METHOD AND APPARATUS FOR CURRENT LIMITATION IN VOLTAGE REGULATORS WITH IMPROVED CIRCUITRY FOR PROVIDING A CONTROL VOLTAGE

PRIORITY CLAIM

This application is a continuation in part of U.S. patent application Ser. No. 10/888,790, filed Jul. 9, 2004, which claims priority to Italian Application Serial Number TO2003A000533, filed Jul. 10, 2003, which are hereby incorporated by reference as if set forth herein.

BACKGROUND OF THE INVENTION

1. Field of the Invention

The invention relates generally to voltage regulators and specifically to limiting the short circuit current in a voltage regulation circuit. More particularly, this invention relates to improved circuitry for providing a control voltage for circuitry that limits the short circuit current.

2. The Prior Art

FIG. 1 is a schematic illustrating a prior art voltage regulator circuit. Circuit 10 includes a power-controlling pass device, for example PMOS transistor 15, coupled between supply voltage 20 and output node 25. A stable output voltage Vout over a defined current IL range is produced between output node 25 and ground. The output of amplifier 30 is coupled to the gate of transistor 15, therefore regulating the behavior of transistor 15. Reference resistors 35 and 40 produce a voltage divider input for amplifier 30 and complete a regulation loop created by transistor 15, amplifier 30, and resistors 35 and 40. Capacitor 45 compensates the regulation loop.

Amplifier 30 compares the voltage across resistor 40 with reference voltage Vbg. Output voltage Vout is determined by the combination of reference voltage Vbg and resistors 35 and 40. As current IL increases above its maximum level, amplifier 30 starts to work in a non-liner mode (i.e. saturation) and as a consequence there is a decline the output voltage Vout. The voltage versus current behavior depends on the characteristics of transistor 15. One problem with circuit 10 is that if transistor 10 is large (for example, in order to have good power supply rejection ratio), then amplifier 30 saturates for high values of current IL even in a regulator that should feature low current range. This means that the regulator presents a very high short circuit current compared to the typical regulator load current. Such short circuit current primarily depends on characteristics of transistor 15 and is not directly controllable.

One solution for the above referenced problem features a switch connected between the gate of transistor 15 and the supply voltage 20, and controlled by the load current value IL. When the current IL is lower than a predetermined threshold the switch is open and the regulator works in normal operation. When IL is higher than the threshold, the switch is closed thus fixing the voltage at the controlling node of transistor 15, and so limiting the short circuit current of the regulator at the selected current threshold. The problem with this approach is that rapid on-off state sequencing of the switch could appear causing oscillation in circuit behavior.

What is needed is a current limitation circuit based on a simple architecture that provides a predictable output response and does not alter the behavior of the regulator in normal operation.

BRIEF DESCRIPTION OF THE INVENTION

A circuit for limiting a power current from a power-controlling pass device, the power-controlling pass device being coupled to a supply voltage, comprises the following. A sense device is coupled to the supply voltage with the sense device being configured to draw a sense current that is proportional to the power current. A current mirror is coupled to the sense device and the supply voltage through a low impedance node, for example a resistor, the current mirror being configured to draw a mirror current through the low impedance node that is relative to the sense current. In one embodiment the mirror current is approximately equal to the sense current, and therefore has approximately the same proportion to the power current. A limiting device is coupled to the supply voltage, the power-controlling pass device, and the low impedance node, the limiting device being configured to limit the power current according to a voltage difference between the low impedance node and the supply voltage. In one embodiment the limiting device, the power-controlling pass device and the sense device are all MOS transistors.

BRIEF DESCRIPTION OF THE DRAWING FIGURES

DETAILED DESCRIPTION OF THE INVENTION

The following description the invention is not intended to limit the scope of the invention to these embodiments, but rather to enable any person skilled in the art to make and use the invention.

Figure 1:
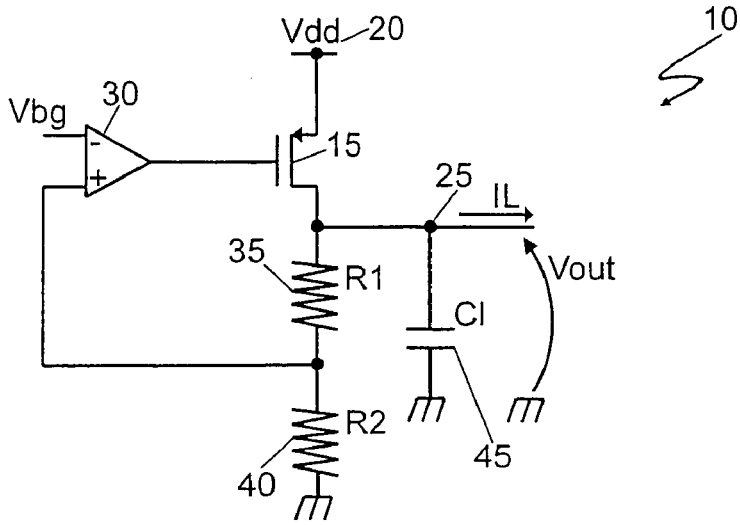
FIG. 1 PRIOR ART
FIG. 1 is schematic diagram illustrating a prior art voltage regulator circuit.
Figure 2:
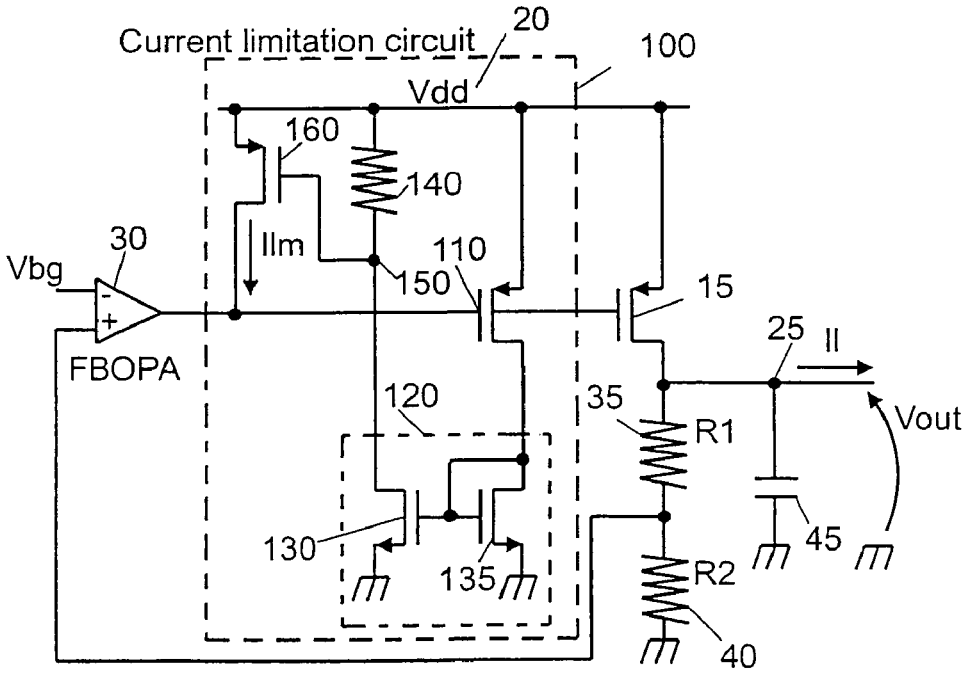
FIG. 2 is schematic diagram illustrating one embodiment of a current limitation circuit implemented with the voltage regulator circuit of FIG. 1.
Figure 8:
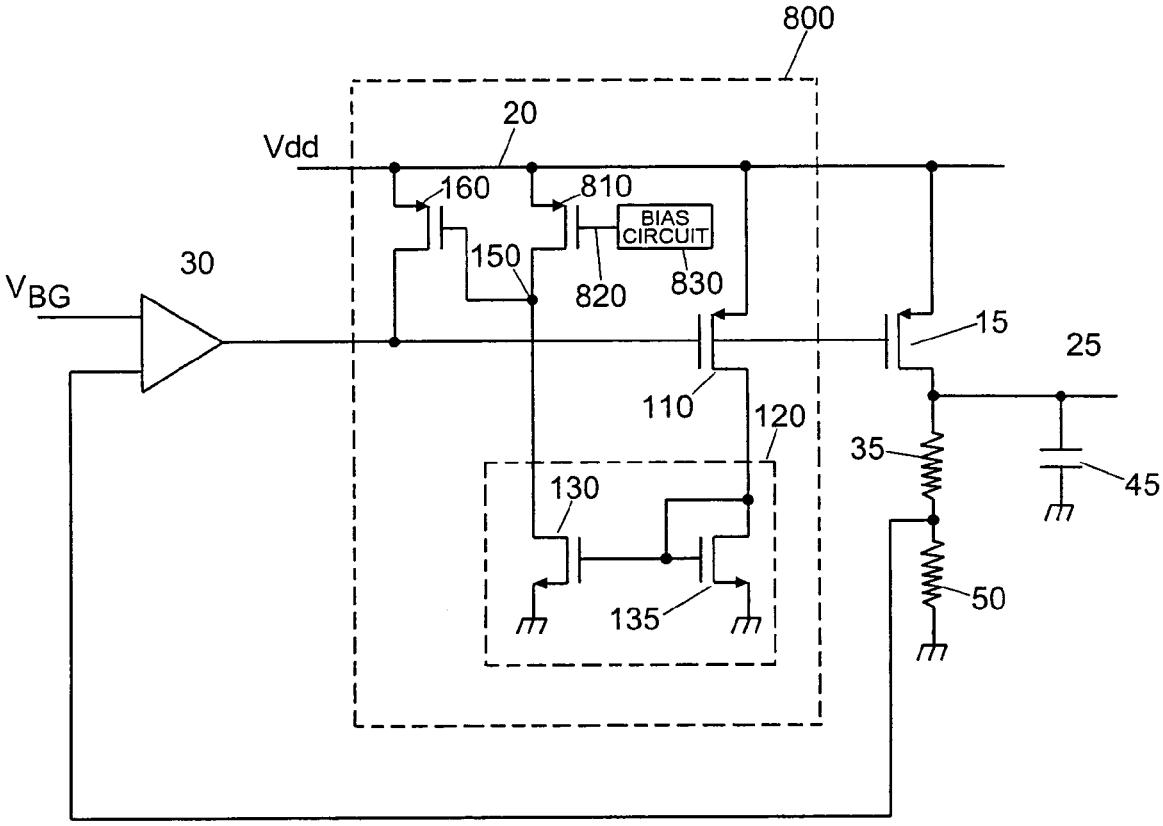
FIG. 8 is a schematic diagram illustrating a second embodiment of the current limitation circuit with a circuitry to improve the performances.

FIG. 2 is schematic illustrating a first exemplary embodiment of a current limitation circuit implemented with the voltage regulator circuit of FIG. 1. Current limitation circuit 100 includes a sense device, for example transistor 110, coupled to supply voltage Vdd, transistor 15, and amplifier 30. In this embodiment transistor 110 is smaller than transistor 15 by a know amount, the sources of both transistors are coupled to supply voltage 20, and both transistors share the same gate voltage from amplifier 30. Transistor 110 couples to current mirror 120, for example transistors 130 and 135 in a current mirror configuration. Current mirror 120 couples to resistor 140 through node 150. Resistor 140 couples to supply voltage 20 and a limiting device, for example transistor 160. Transistor 160 couples to amplifier 30. Node 150 is a low impedance node based on the voltage drop from supply voltage 20 across resistor 140. In another embodiment, transistor 160 is coupled to a low impedance node other than a resistor, for example a PMOS transistor properly biased in the triode region as is shown in FIG. 8 and described below.

The sense device should provide a current based on the current of the device it is sensing. In this embodiment, sense device, or transistor 110, is smaller than transistor 15 by a known ratio and therefore provides a current through itself with the known ratio to the current through transistor 15. Current through transistor 110 necessarily passes through current mirror 120 and transistor 135 to ground. Current through node 150 and into current mirror 120 reflects, or approximates, current through transistor 110. Current mirrors may provide whatever ratio of current is desired, but in this embodiment a one-to-one ratio is used. Current through node 150 approximates the current through transistor 15 by the ratio of transistor 110 to transistor 15. If K is the ratio of transistor 110 to transistor 15 and current through transistor 15 is I1 (neglecting current through resistors 35 and 40), then current through node 150 is K·I1.

In one embodiment, resistor 140 couples to supply voltage 20 and converts K·I1 into a voltage across the source and gate of transistor 160. Limiting device, or transistor 160, clamps the voltage at the gates of transistors 110 and 15. Transistor 160 is driven through its gate by the voltage across resistor 140 with a resistance of Rlm, for a gate voltage of Rlm·K·I1. In one embodiment transistor 160 is a PMOS transistor.

Transistor 160 is driven by a low impedance node and may operate in saturation, so the transition between normal operation to an overcurrent mode is continuous and no stability problems appear since no on-off state sequence of transistor 160 occurs.

Figure 3:
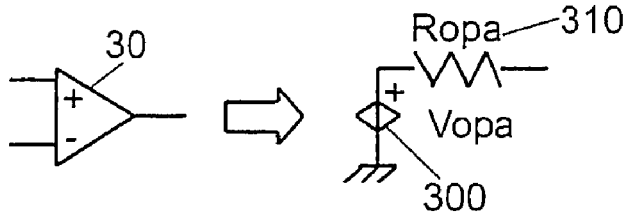
FIG. 3 is a schematic diagram illustrating a circuit equivalent for an amplifier.

FIG. 3 is a schematic illustrating a circuit equivalent for amplifier 30 from FIG. 2. In one embodiment amplifier 30 is an operational amplifier. A macromodel circuit of amplifier 30 represents the behavior of amplifier 30. The macromodel circuit is composed of ideal voltage controlled voltage source 300 with a voltage of Vopa and resistor 310 with a resistance of Ropa. In this macromodel $$Vopa = \begin{cases} Vdd - Vs & \text{when } Av\cdot(V_+ - V_-) > Vdd - Vs \\ Av\cdot(V_+ - V_-) & Vs < Av\cdot(V_+ - V_-) < Vdd - Vs \\ Vs & \text{when } Av\cdot(V_+ - V_-) < Vs, \end{cases}$$

where Vs is the saturation voltage of amplifier 30, Av is the DC differential voltage gain of amplifier 30, Vdd is supply voltage 20, $V_+$ is the noninverting input to amplifier 30, and $V_-$ is the inverting input to amplifier 30.

Vg is the gate voltage of transistors 110 and 15. Vg is determined by amplifier 30 and transistor 160:

$$Vg = Vopa + Ropa\cdot \mathrm{Ilm}.$$

Ilm is the drain current of transistor 160 that is, when transistor 160 is on and in saturation:

$$Ilm = \frac{\beta lm}{2}\cdot(K\cdot Rlm\cdot Il - |Vtop|)^2,$$

where Vtop is the threshold voltage and βlm is the gain factor of transistor 160. So $$Vg = Vopa + FIL, \text{ where}$$

$$FIL \equiv \begin{cases} Ropa\cdot\frac{\beta \mathrm{lm}}{2}\cdot(K\cdot Rlm\cdot Il - |Vtop|)^2 & \text{for } K\cdot Rlm\cdot Il > |Vtop| \\ 0 & \text{otherwise.} \end{cases}$$

Current limitation circuit 100 has three modes of operation: normal, overcurrent and short circuit. In normal operation, load current I1 increases from zero and the regulation loop (transistor 15, resistors 35 and 40, and amplifier 30) makes Vout stable by adapting (i.e., by reducing) voltage Vopa. Once I1 increases to where Rlm·K·I1>|Vtop| (the threshold voltage of transistor 160), transistor 160 turns on and begins injecting current Ilm into the output of amplifier 30 and so modifying voltage Vg (the gate voltage of transistors 110 and 15). While amplifier 30 is in the linear region, voltage Vopa is adapted to compensate the effect of Ilm and Vout remains stable. In normal operation transistor 15 is in the triode region and amplifier 30 is in the linear region, so:

$$Il = \beta reg\cdot\left[(Vg - Vdd) - \frac{Vout - Vdd}{2} - Vtop\right]\cdot(Vout - Vdd),$$

where $$Vg = Av\cdot\left(\frac{Vout\cdot R2}{R12} - Vbg\right) + FIL,\ R12 = R1 + R2,$$

βreg is the gain factor of transistor 15, R1 is the resistance of resistor 35 and R2 is the resistance of resistor 40. Substituting, the equation for Vg into the equation for I1, $$\left(Av\cdot\frac{R2}{R12} - \frac{1}{2}\right)\cdot Vout^2 + \left(-Av\cdot Vbg + FIL - Av\cdot\frac{R2}{R12}\cdot Vdd - Vtop\right)\cdot Vout + \left(Av\cdot Vbg\cdot Vdd - FIL\cdot Vdd + \frac{Vdd^2}{2} + Vtop\cdot Vdd - \frac{Il}{\beta reg}\right) = 0.$$

So, solving the quadratic equation for Vout:

$$Vout = \frac{-B - \sqrt{B^2 - 4\cdot A\cdot C}}{2\cdot A}$$

-continued $$A = \left(Av \cdot \frac{R2}{R12} - \frac{1}{2}\right)$$

$$B = \left(-Av \cdot Vbg \cdot FIL - Av \cdot \frac{R2}{R12} \cdot Vdd - Vtop\right)$$

$$C = \left(Av \cdot Vbg \cdot Vdd - FIL \cdot Vdd + \frac{Vdd^2}{2} + Vtop \cdot Vdd - \frac{Il}{\beta reg}\right)$$

This is valid while amplifier 30 is in the linear region, i.e., $$Vopa > Vs \text{ then}$$

$$Av \cdot \left(\frac{Vout \cdot R2}{R12} - Vbg\right) > Vs \text{ then}$$

$$Vout > \frac{R12}{R2} \cdot \left(\frac{Vs}{Av} + Vbg\right).$$

As I1 increases, Vopa decreases until it reaches Vs and amplifier 30 leaves the linear region and current limitation circuit 100 goes into overcurrent operation. The transition from normal to overcurrent operation is continuous and stable because a low impedance node (resistor 140) drives transistor 160 and transistor 160 is in saturation when reaching the saturation voltage of amplifier 30. The regulation loop does not work and voltage Vg becomes $$Vg = Vs + FIL.$$

As I1 increases, the drain-to-source voltage of transistor 15 increases, and Vout starts to decrease. Due to current limitation circuit 100, Vg (gate voltage for transistors 110 and 15) is limited not to Vs (saturation voltage of amplifier 30), which occurs when no current limitation is present, but to a higher value, so the output voltage Vout begins decreasing at a lower level of load current I1.

During overcurrent operation, the current in transistor 15 is $$Il = \beta reg \cdot \left[(Vg - Vdd) - \frac{Vout - Vdd}{2} - Vtop\right] \cdot (Vout - Vdd).$$

Substituting, for Vg yields $$-\frac{1}{2} \cdot Vout^2 + (Vs + FIL - Vtop) \cdot Vout + \left(-Vs \cdot Vdd - FIL \cdot Vdd + \frac{Vdd^2}{2} + Vtop \cdot Vdd - \frac{Il}{\beta reg}\right) = 0.$$

Solving for Vout:

$$Vout = \frac{-B - \sqrt{B^2 - 4 \cdot A \cdot C}}{2 \cdot A}$$

$$A = -\frac{1}{2}$$

$$B = (Vs + FIL - Vtop)$$

-continued $$C = \left(-Vs \cdot Vdd - FIL \cdot Vdd + \frac{Vdd^2}{2} + Vtop \cdot Vdd - \frac{Il}{\beta reg}\right).$$

This is valid while transistor 15 is in the triode region, $$Vs + FIL + |Vtop| < Vout < \frac{R12}{R2} \cdot \left(\frac{Vs}{Av} + Vbg\right).$$

As I1 increases again, Vout decreases and transistor 15 exits the triode region and enters saturation. Current limitation circuit 100 now enters short circuit operation. Load current I1 is, while neglecting the channel modulation in transistor 15, $$Il = \frac{\beta reg}{2} \cdot (Vdd - Vg - Vtop)^2,$$

where $$Vg = Vs + FIL.$$

Substituting for Vg yields:

$$Il = \frac{\beta reg}{2} \cdot (Vdd - Vs - FIL - Vtop)^2,$$

and Vout goes to zero.

This value for load current I1 represents the short circuit current, i.e., the current flowing in transistor 15 when Vout is zero (note that FIL is a function of I1, so the equation must be solved numerically). The short circuit current can be programmed by choosing the value of K, Rlm, and the size of transistor 160.

Without current limitation circuit 100, the short circuit current is $$Il = \frac{\beta reg}{2} \cdot (Vdd - Vs - Vtop)^2,$$

which is higher than the short circuit current with current limitation circuit 100.

Figure 4:
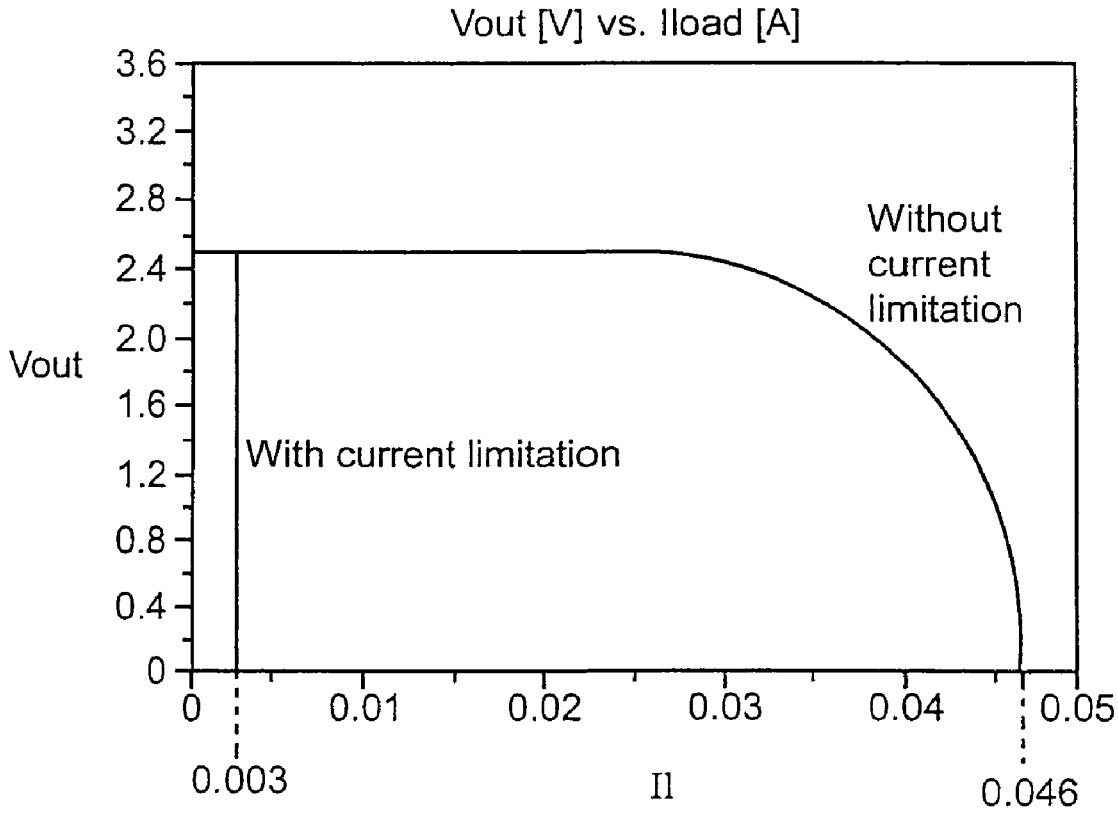
FIG. 4 is a graph illustrating output voltage versus load current for a voltage regulator with and without current limitation.

FIG. 4 is a graph illustrating output voltage Vout versus load current I1 for a voltage regulator with and without current limitation. With current limitation, the short circuit current is approximately 3 mA. Without current limitation, the short circuit current is approximately 46 mA.

Figure 5:
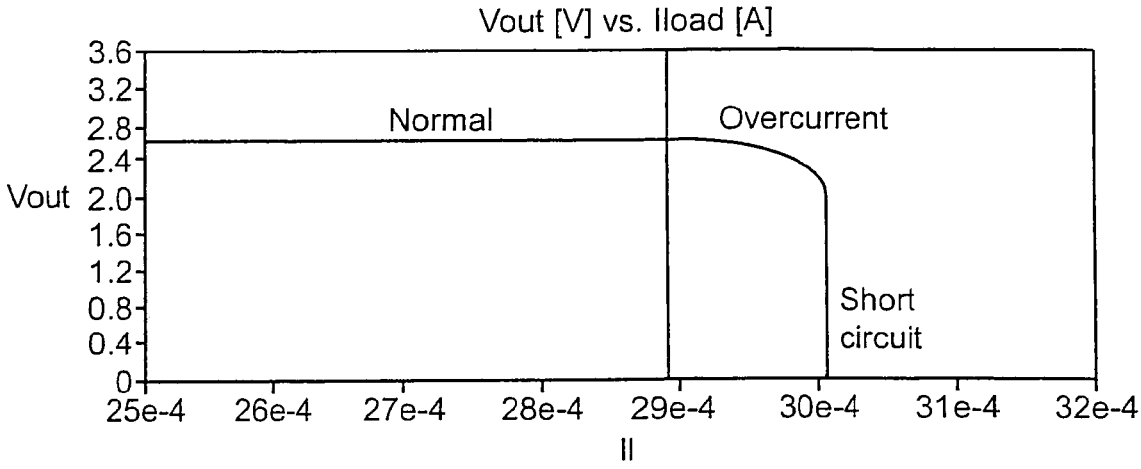
FIG. 5 is a graph illustrating output voltage versus load current for a voltage regulator with current limitation.

FIG. 5 is a graph illustrating output voltage versus load current for a voltage regulator with current limitation, from normal to overcurrent to short circuit operation. Normal operation, where the regulation loop regulates Vout by reducing Vopa as I1 increases, is relatively stable at approximately 2.5 V while current increases to approximately 2.9 mA. Overcurrent mode, where amplifier 30 is saturated and Vg is limited, shows current increasing from approximately 2.9 mA to approximately 3.0 mA while Vout decreases from approximately 2.5 V to approximately 2.0 V. Short circuit mode, where transistor 15 is in saturation, shows current reaching a maximum value of approximately 3 mA while Vout drops to approximately 0 V.

Figure 6:
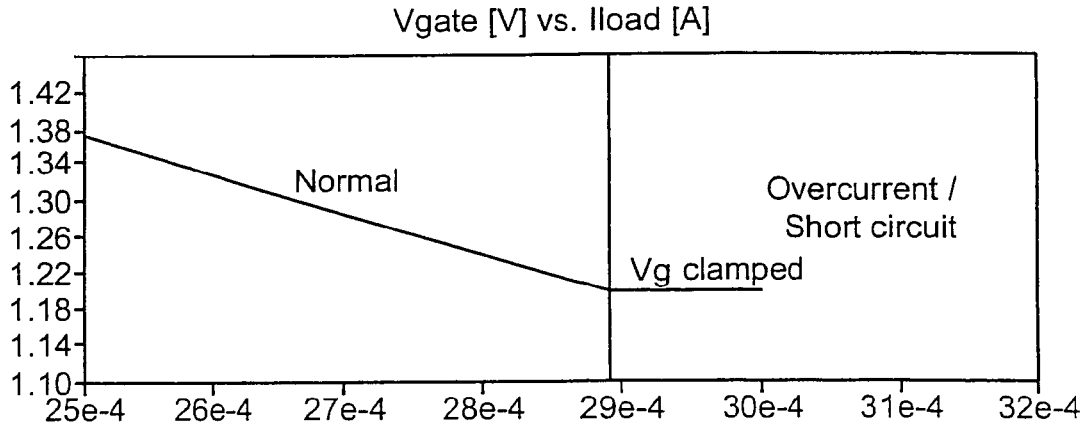
FIG. 6 is a graph illustrating control voltage versus load current for a voltage regulator with current limitation.

FIG. 6 is a graph illustrating gate voltage Vg for transistors 15 and 110 versus load current I1 for a voltage regulator with current limitation. During normal operation, gate voltage Vg drops from approximately 1.38 Vto approximately 1.19 V while current increases from approximately 2.5 mA to approximately 2.9 mA. At 2.9 mA of current I1, current limitation circuit 100 functions to clamp the Vg at approximately 1.19 volts as current I1 increases to 3 mA.

Figure 7:
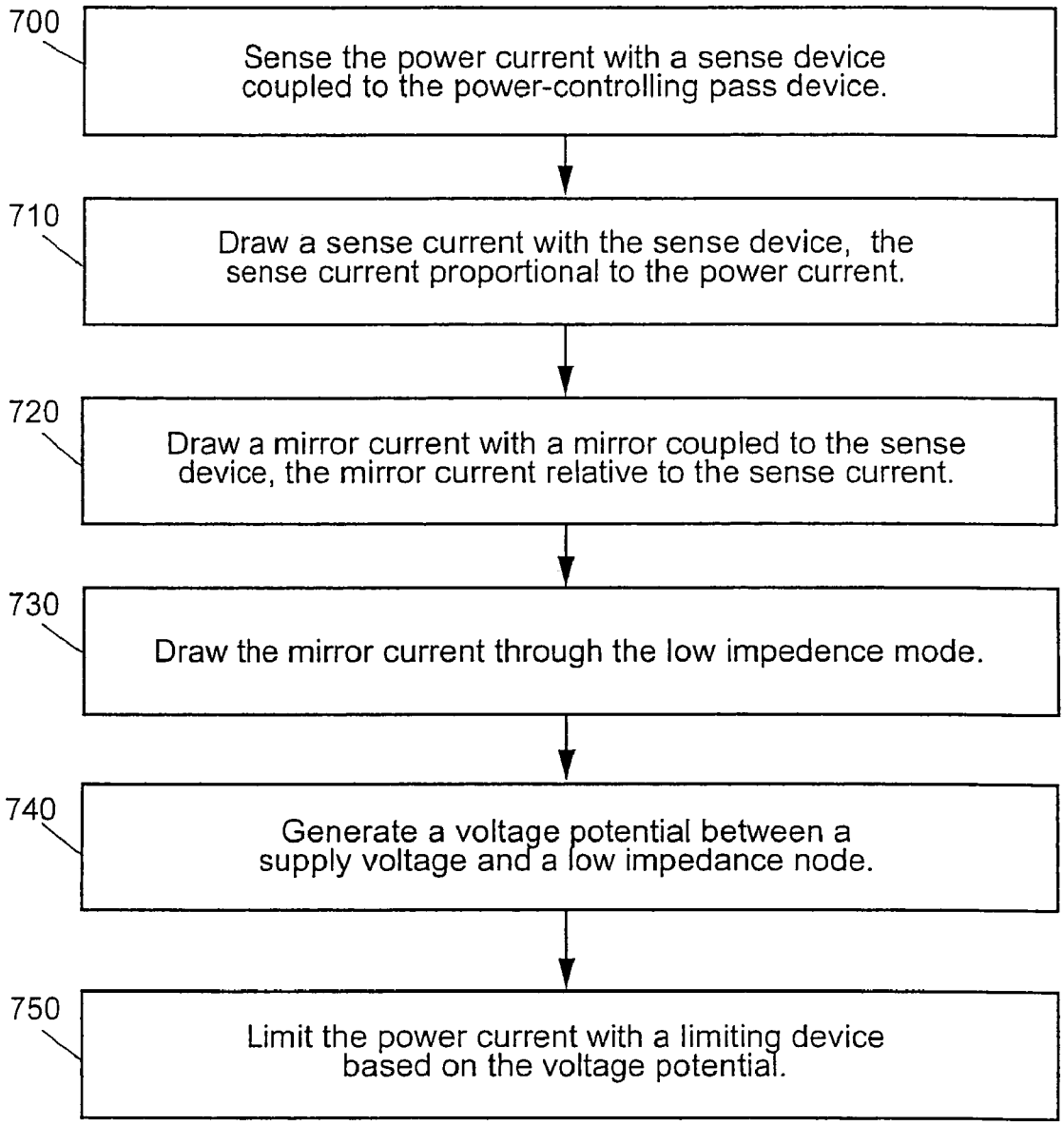
FIG. 7 is a block diagram illustrating a method for limiting power current from a power-controlling pass device.

FIG. 7 is a block diagram illustrating a method for limiting power current from a power-controlling pass device. In block 700, sense the power current with a sense device coupled to the power-controlling pass device. In block 710, draw a sense current with the sense device, the sense current proportional to the power current. In block 720, draw a mirror current with a current mirror coupled to the sense device, the mirror current relative to the sense current. In block 730, draw the mirror current through the low impedance node. In block 740, generate a voltage potential between a supply voltage and a low impedance node. In block 750, limit the power current with a limiting device based on the voltage potential.

The resistor 140 in the current limiting circuit 100 (FIG. 2) that provides a control voltage for transistor 160, features a poor tolerance. Typical tolerance values for integrated polysilicon resistors are ±20%. Such a poor tolerance directly affects the behavior, i.e., the precision, of the current limiting circuit. Moreover, extraneous factors such as supply voltage changes, temperature changes, and variations in technological parameters, affect the behavior of the circuit thus making the short circuit current value very sensitive to these variations.

FIG. 8 illustrates a second exemplary embodiment of this invention that allow to improve the performances, i.e., make the short circuit current value less sensitive to supply voltage changes, temperature changes, and variations in technological parameters. In this embodiment the circuit 800 replaces the current limiting circuit 100.

In the current limitation circuit 800, instead of resistor 140 (FIG. 2) the PMOS transistor 810 is used to provide the control voltage to transistor 160. The source of transistor 810 is connected to supply voltage 20. The drain of transistor 810 is connected to current mirror 120 and node 150. A biasing voltage is applied by biasing circuit 830 via path 820 to the gate of transistor 810. The biasing voltage is chosen to cause transistor 810 to be biased in the triode region. However, if the biasing voltage remains constant, transistor 810 presents the same problems as resistor 140. In order to prevent this problem the biasing voltage should be adaptable in an automatic fashion.

Figure 9:
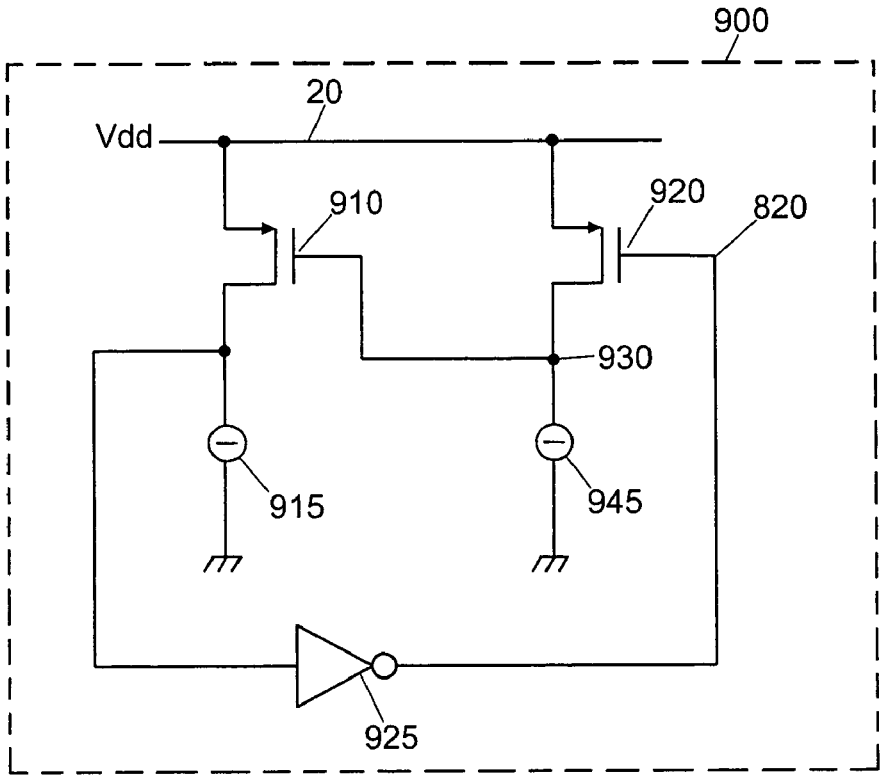
FIG. 9 is a schematic diagram illustrating an exemplary embodiment of bias circuit for the limitation circuit of FIG. 8.

FIG. 9 illustrates an exemplary embodiment of biasing circuit 830. Biasing circuit 900 includes a first transistor 910 that replicates transistor 160 and a second transistor 920 that replicates transistor 810. First transistor 910 has a source connected to supply voltage 20 and a drain connected to a first current source 915 and input of inverting amplifier 925. The gate of first transistor 910 is connected to node 930 between the drain of the second transistor 920 and second current source 940. Transistor 920 is biased in triode region, thus node 930 is a low impedance node.

A source of second transistor 920 connects to supply voltage 20. A drain of second transistor 920 connects to a second current source 945 through node 930. The gate of second transistor 920 connects to path 820 which applies the biasing voltage to transistor 810.

First current source 915 is connected between the drain of first transistor 910 and ground. First current source supplies a current equal to I2 which is the amount of current that flows through transistor 160 in short circuit mode. Second current source 945 is connected between supply voltage 29 and ground. Second current source 945 provides current equal to I1 which is the amount of current flowing through transistor 810 during short circuit mode, i.e., K·Ishort.

Inverting amplifier 925 closes the loop of bias circuit 900. Inverting amplifier 925 has an input connected to the drain of first transistor 910 and first power source 915. The output of inverting amplifier is connected to path 820 that supplies the biasing voltage.

Bias circuit 900 is a replica of the limiting circuit 800 and has a bias point equal to limiting circuit 800. Thus, the bias voltage generated by bias circuit 900 is the correct bias for transistor 810. Bias circuit 900 adapts the bias voltage according to the imposed values I1 and I2, to cope for supply, temperature, and technological parameters variations. The short circuit current value is determined by I1. I2 is determined by the output resistance of limiting circuit 800.

Figure 10:
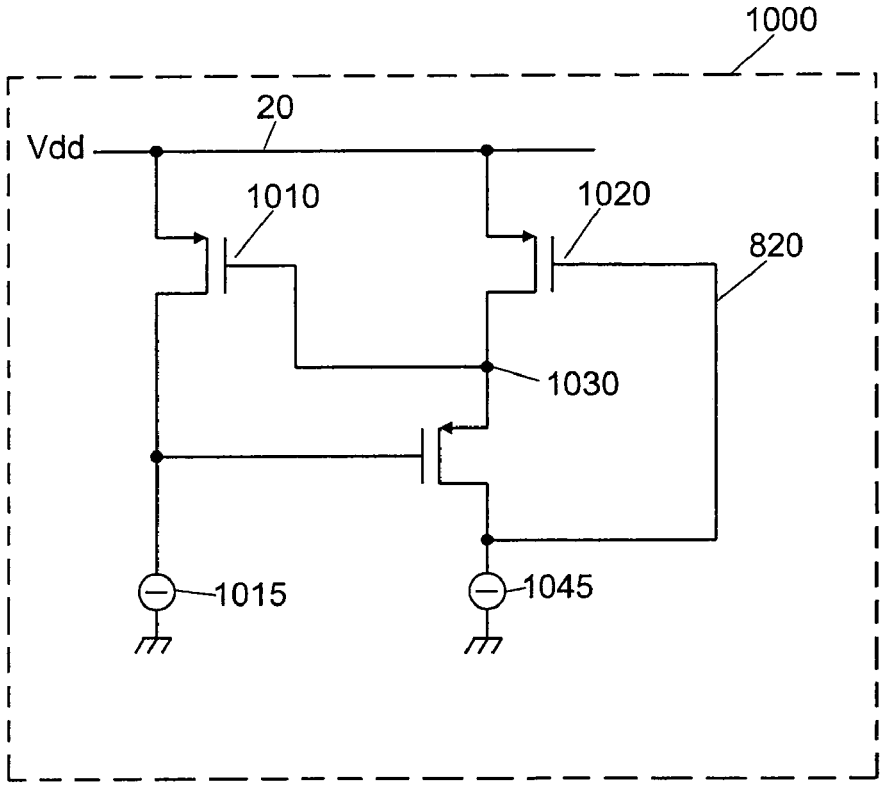
FIG. 10 is a schematic diagram illustrating a second exemplary embodiment of bias circuit for the limitation circuit of FIG. 8.

FIG. 10 is a second exemplary embodiment of biasing circuit 830. Basing circuit 1000 features a medium loop gain with respect biasing circuit 900. The medium loop gain makes stabilization of the loop easier. Biasing circuit 1000 includes a first transistor 1010 that replicates transistor 160 and a second transistor 1020 that replicates transistor 810. First transistor 1010 has a connected to supply voltage 20 and a drain connected to a first current source 1015 and input of the gate of third transistor 1025. The gate of first transistor 1010 is connected to node 1030 between the drain of second transistor 1020 and the source of third transistor 1025. Transistor 1020 is biased in triode region, thus node 1030 is a low impedance node.

A source of second transistor 1020 connects to supply voltage 20. A drain of second transistor 1020 connects to the source of third transistor 1025 through node 1030. The gate of second transistor 1020 connects to path 820 which applies the biasing voltage to transistor 810.

First current source 1015 is connected between the drain of first transistor 1010 and ground. First current source supplies a current equal to I2 which is the amount of current that flows through transistor 160 in short circuit mode. Second current source 1045 is connected between the drain of third transistor 1025 and ground. Second current source 1045 provides current equal to I1 which is the amount of current flowing through transistor 810 during short circuit mode, i.e., K·Ishort.

Third transistor 1025 closes the loop of bias circuit 1000. The source of third transistor 1025 is connected to a drain of second transistor 1020 and the gate of first transistor 1010 through node 1030. The gate of third transistor 1025 is connected the drain of first transistor 1010 and first current source 1015. The drain of third transistor is connected to path 820 and the second current source 1045.

Figure 11:
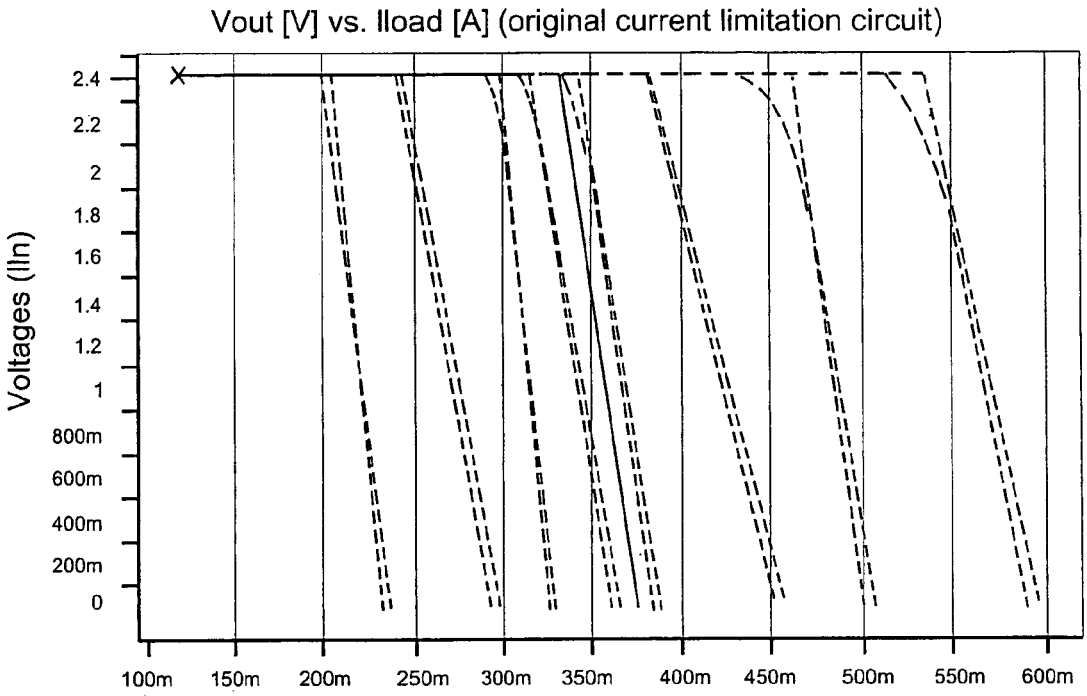
FIG. 11 is a drawing illustrating the original limitation circuit without the circuitry to improve the performances.

FIG. 11 illustrates a graph showing current limiting with a circuit 100 including a limiting resistor. In the simulations, the supply voltage is varies between 3 volts and 4.2, the temperature is varied between −20 Celsius and +125 Celsius, and the other technological variances are applied (±20% of resistor tolerance is also considered). In FIG. 11, the results of the various simulations show short circuits at currents varying from 230 milliamps of current to 630 milliamps of current.

Figure 12:
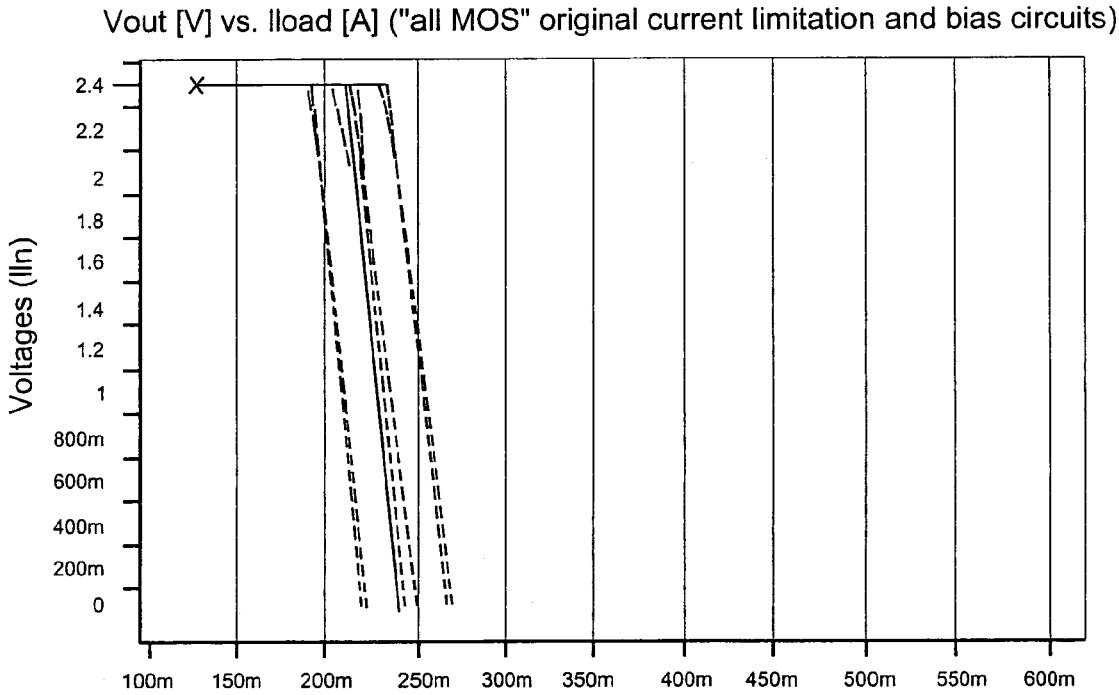
FIG. 12 is a drawing illustrating the limitation circuit with the circuitry to improve the performances shown in FIG. 8 with the bias circuit for the limitation circuit shown in FIG. 10.

FIG. 12 is a graph showing current limiting with a circuit 800 including a limiting transistor 810 and bias circuit 1000. In the simulations, the supply voltage is varied between 3 volts and 4.2, the temperature is varied between −20 Celsius and +125 Celsius, and the other technological variances are applied. In FIG. 12 the results of the various simulations show short circuits at currents varying from 220 milliamps of current to 270 milliamps of current.

From the two graphs, it is apparent that risk of circuit damage is less with circuit 800 and the bias circuit 1000, as the short circuit current is 270 milliamps compared to the 630 milliamps of circuit 100. A second advantage of circuit 800 and 1000 is that metal traces in the circuit may be smaller since only 270 milliamps have to be carried by the traces in short circuit mode.

The preceding equations apply to one exemplary embodiment and are not meant to limit the invention. The equations are presented in order to assist in understanding one embodiment of the invention. Any person skilled in the art will recognize from the previous description and from the figures and claims that modifications and changes can be made to the invention without departing from the scope of the invention defined in the following claims.

The invention claimed is:

1. A circuit for limiting a power current from a power-controlling pass device, the power-controlling pass device coupled to a supply voltage, comprising:

a sense device coupled to the supply voltage, the sense device configured to draw a sense current that is proportional to the power current;

a current mirror coupled to the sense device and coupled to the supply voltage, the current mirror configured to draw a mirror current that is relative to the sense current;

a resistance device coupled to the supply voltage and to the current mirror, the limiting transistor configured generate a resistor voltage potential;

a limiting device coupled to the supply voltage, the power-controlling pass device, and to the resistor, the limiting device configured to limit the power current according to the resistor voltage potential; and a bias circuit that generates a bias voltage to adjust said resistance voltage to change said resistance voltage potential comprising:

a first current source supplying a first current wherein said first current is substantial to current flowing through said limiting device during a short circuit, a second current source supplying a second current wherein said second current is substantially equal to current flowing through said resistance device during a short circuit, a first device that replicates said limiting device coupled to said supply voltage and said second current source, and a second device that replicates said resistance device coupled to said supply voltage and said first current source.

2. The circuit of claim 1 wherein the sense device is smaller than the power-controlling pass device.

3. The circuit of claim 2 wherein the proportion of the sense current to the power current is the same as the proportion of the size of the sense device to the size of the power-controlling pass device.

4. The circuit of claim 3 wherein the limiting device, the sense device and the power-controlling pass device, and resistance device are MOS transistors.

5. The circuit of claim 1 wherein the sense device is further coupled to the power-controlling pass device and to the limiting device, the limiting device configured to limit the sense current according to the resistor voltage potential.

6. The circuit of claim 1 wherein the mirror current is approximately the same as the sense current.

7. The circuit of claim 1 further comprising an amplifier coupled to the sense device, the power-controlling pass device, and the limiting device, the amplifier having a saturation voltage.

8. The circuit of claim 7 further configured to function in three states, normal operation, overcurrent operation, and short circuit operation, normal operation occurring while the amplifier operates below its saturation voltage.

9. The circuit of claim 8 wherein the sense device, the power-controlling pass device, and the limiting device are MOS transistors, wherein the amplifier is coupled to the gate of the power-controlling pass device.

10. The circuit of claim 9 further configured to respond to overcurrent operation, which occurs when the amplifier reaches its saturation voltage and the power current increases, by clamping voltage at the gate of the power-controlling pass device using the limiting device.

11. The circuit of claim 10 further configured to respond to overcurrent operation with the limiting device in saturation.

12. The circuit of claim 9 further configured to respond to short circuit operation, which occurs when the power-controlling pass device operates in saturation, by having the power-controlling pass device drop the power current to approximately zero.

13. The circuit of claim 1 further comprising:

an inverting amplifier connected between said first device and an output of said bias circuit.

14. The circuit of claim 1 further comprising:

a third device connected coupled to said resistance device, said second current source, said output of said bias circuit.

15. The circuit of claim 14 wherein said third device is controlled by voltage between said first device and said first current source.

16. The circuit of claim 1 wherein said first device is controlled by voltage across said second device and said second current source.

17. The circuit of claim 1 wherein said second device is controlled by said bias output voltage output from said bias circuit.

18. A method for limiting a power current from a power-controlling pass device coupled to a supply voltage, the method comprising:

generating a voltage potential between the supply voltage and a low impedance node;

limiting the power current with a limiting device based on the voltage potential; and adjusting said voltage potential generated to control said limiting of the power current with a resistance device by generating a bias voltage to adjust said resistance voltage to chance said resistance voltage potential wherein said step of generating of said bias voltage comprises:

supplying a first current wherein said first current is substantial to current flowing through said limiting device during a short circuit, supplying a second current wherein said second current is substantially equal to current flowing through said resistance device during a short circuit, replicating said limiting device coupled to said supply voltage and said second current source, and replicating said resistance device coupled to said supply voltage and said first current source.

19. The method of claim 18 further comprising:

sensing the power current with a sense device coupled to the power-controlling pass device.

20. The method of claim 19 further comprising:

drawing a sense current with the sense device, the sense current proportional to the power current.

21. The method of claim 20 wherein the sense device is smaller than the power-controlling pass device and the sense current has the same proportion to the power current as the sense device has to the power-controlling pass device.

22. The method of claim 20 further comprising:

drawing a mirror current with a current minor coupled to the sense device, the mirror current relative to the sense current.

23. The method of claim 22 wherein the mirror current is approximately equal to the sense current.

24. The method of claim 23 further comprising:

drawing the mirror current through the low impedance node.

* * * * *